United States Patent [19]

DiMatteo et al.

[11] Patent Number: 4,726,082

[45] Date of Patent: Feb. 23, 1988

[54] INVALID TRANSFER ARRANGEMENT

[75] Inventors: Paul DiMatteo, Dix Hills; Charles F. Chubb, Brookville; Stewart Senator, Patchogue, all of N.Y.

[73] Assignee: Nova Technologies, Inc., Hauppauge, N.Y.

[21] Appl. No.: 825,204

[22] Filed: Feb. 3, 1986

Related U.S. Application Data

[63] Continuation-in-part of Ser. No. 731,533, May 7, 1985.

[51] Int. Cl.[4] ..... A61G 7/08

[52] U.S. Cl. ..... 5/81 R; 5/61; 5/81 R; 5/81 C

[58] Field of Search ..... 5/61, 81 R, 81 C, 83; 297/353

[56] References Cited

U.S. PATENT DOCUMENTS

| | | | |
|---|---|---|---|
| 716,886 | 12/1902 | Goode | 5/81 B |
| 2,208,410 | 7/1940 | Carter | 5/81 B |
| 3,609,357 | 9/1971 | Jones | 5/61 |
| 3,886,610 | 6/1975 | Shelden | 5/61 |
| 4,067,409 | 1/1978 | DiMatteo et al. | 297/353 |

FOREIGN PATENT DOCUMENTS

| | | | |
|---|---|---|---|
| 172296 | 2/1986 | European Pat. Off. | 5/81 R |
| 23954 | of 1910 | United Kingdom | 5/81 B |

*Primary Examiner*—Alexander Grosz
*Assistant Examiner*—Michael F. Trettel
*Attorney, Agent, or Firm*—Max Fogiel

[57] ABSTRACT

Apparatus used in conjunction with a bed and having rollers and a transfer sheet to transport a patient over the bed and partially onto a horizontal seat of a wheelchair. The patient is then raised to a normal seated position, without requiring any effort on the part of the patient. The patient can also be transported to a sitting position at the end of the bed, or to a standing position on the floor. The apparatus is arranged for installation on existing hospital or home-type beds so that a patient can be comfortably transported to a seated position on a wheelchair, commode, surface, or to a seated or standing position at the end of the bed.

9 Claims, 36 Drawing Figures

INVALID TRANSFER ARRANGEMENT

BACKGROUND OF THE INVENTION

The present application is a continuation-in-part of the parent application Ser. No. 731,533 filed May 7, 1985.

The process of transferring an invalid person from a bed to a wheelchair, to a commode, to a toilet, or to a standing position, or assisting such a person in such a transfer, often involves more than one person to assist, is labor intensive and consequently can be costly. The task frequently requires considerable strength and is a common source of injury to the person being transferred or to the nurse(s) or attendant(s) doing the transfer. These problems often are the major factors that require a person to be hospitalized or moved to a nursing home, rather than being cared for at home. They also increase the cost of caring for persons in hospitals and nursing homes.

Even when a patient is not seriously disabled and may be capable of walking, once he is standing, he may have great difficulty and may require assistance in getting in and out of bed and in getting from a bed to a wheelchair. The patient may also require assistance in reaching a sitting position at the side or end of the bed. The parent application describes an arrangement for transferring an invalid person from a bed to a separate horizontal surface by means of a sheet which was pulled over the surface of the mattress by being rolled up on a roller at the foot of the bed and unrolled from a roller at the head of the bed.

Accordingly, it is the primary object of the present invention to provide additional apparatus on a bed equipped with rollers and a transfer sheet, and on an associated wheelchair, so that a patient can be comfortably transported over the bed and partially onto the horizontal seat of the wheelchair and then raised to a normal seated position thereon, with no effort on the part of the invalid person. Minimal physical strength or skill on the part of an attendant is to be required according to the present invention.

It is another objective of the present invention to provide means for comfortably transporting an invalid person in a similar manner to a sitting position at the end of the bed or to a standing position on the floor, with little or no effort on the part of the person and requiring only moderate physical strength or skill from an attendant.

It is still another object of the present invention to provide apparatus which can be installed on existing hospital or home-type beds so that a person can be comfortably transported to a seated position on a wheelchair, commode, surface, or apparatus, or to a seated or standing position at the end of a bed.

Additional objects and advantages of the present invention will become evident from the following description of specific embodiments when read in connection with the accompanying drawings.

DESCRIPTION OF THE PREFERRED EMBODIMENTS

Figure 1A:
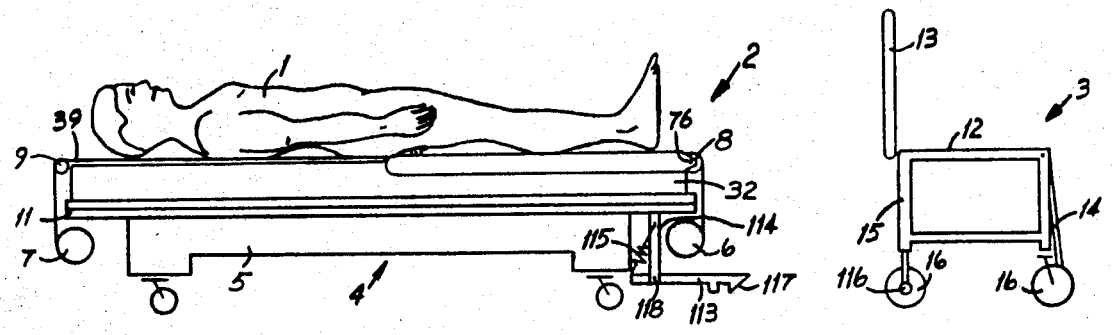
FIGS. 1*a* through 1*f* are schematic sequenced views showing the operation of the present invention in transferring a supine person on a bed to a seated position on a wheelchair.

FIGS. 1*a* through 1*f* schematically illustrate the principles used to transport a person 1 from a bed 2 to a wheelchair 3.

The bed 2 consists of a conventional bed 4 as found in a home or institution such as a hospital or nursing home with modifications to be described. An elevating device 5, either manual or power driven, as is found on hospital type and some home beds, is used to raise or lower the bed 2 to the proper height to perform the required operations. Alternatively, a conventional home bed may be blocked up to the proper height and left there for the duration of the patient's use.

Also attached to the bed 4 is an arrangement for transporting a person 1 from a postion on the bed to and beyond the edge of the bed.

This arrangement contains a foot-end roller 6 (shown in FIG. 1*a*) whose length is approximately equal to the width of the bed, and which is mounted to the bed frame at the foot-end of the bed. A similar head-end roller 7 is positioned at the head-end of the bed. (Head and foot are described from the patient's point of view.) A specially designed bed sheet 39, approximately equal in width to the width of the bed and significantly longer than the bed, is fastened to and partially rolled up on the head-end roller 7 while the other end is fastened to the foot-end roller 6 at the foot-end of the bed.

It is generally desirable to keep the length of the modified bed 2 as short as possible. For this reason, although not a requirement of this invention, the rollers 6 and 7 are shown located under the main bed frame members 11. To ease the transport of the sheet 39 over the mattress 32, a foot-end corner roller 8 and head-end corner roller 9 are mounted to the bed frame 11. These rollers 8 and 9 are preferably constructed with stiff cores covered with soft material. The tops of these rollers are approximately level with the top surface of the mattress 32.

Mechanical power for driving the two rollers to wind up the sheet on one roller while allowing it to unwind from the other so as to move the sheet over the surface of the mattress and to transport a reclining person from a position on the bed 2 to and beyond the end of the bed, is provided from electric motor drives or hand cranks as described subsequently.

This particular arrangement of rollers is shown to help illustrate the principles of this invention, but the invention is not limited to this configuration, and other arrangements for moving a sheet across a bed to transport a person over the bed can be used equally well. Some of these are described subsequently.

The wheelchair 3 consists of the elements normally found on a conventional wheelchair: a seating area 12, a backrest 13, and a leg rest 14, all attached to a frame 15. The whole assembly is supported on wheels 16. The wheels 16 are depicted as small and of approximately equal size, but, as in conventional chairs in the art, either pair may be castered or fixed, or either the front or rear pair may be large with fixed axles and the other pair castered. Although not a requirement of this invention, a leg rest 14, which can be raised and lowered by conventional means well known in the art, can be used. If used, it should preferably have a full leg or calf support and adjustable foot plates.

Figure 1B:
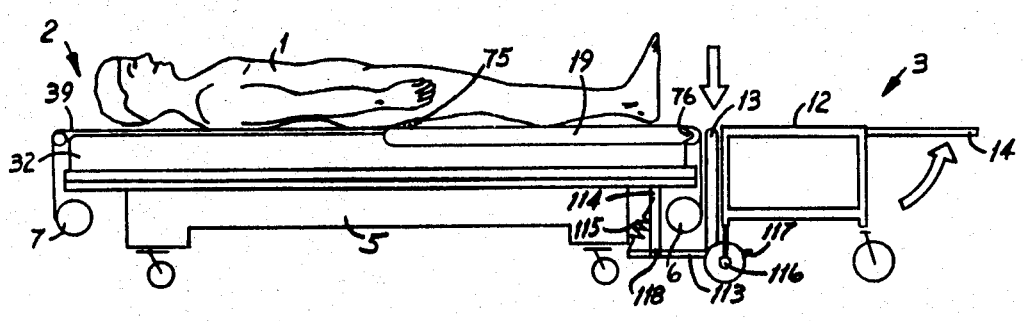

For the present invention, the top of the wheelchair backrest 13 can be moved from the normal position shown in FIG. 1*a*, to a position flush with or below the level of the seat as indicated in FIG. 1*b*.

A latch 113 is mounted to bed 2. As chair 3 moves toward bed 2, as shown in sequence in FIGS. 1*a* to 1*b*, axle rod 116 on chair 3 will strike the front face 117 of latch 113 causing it to pivot counter-clockwise about axle rod 118 in support 114. As the chair 3 moves further, spring 115 between support 114 and latch 113 will cause latch 113 to pivot clockwise. This locks rod 116 and thereby holds chair 3 in position for transferring a person, as shown in FIG. 1*b*. At the conclusion of the transfer, the latch 113 may be manually lifted to allow the chair 3 to be moved away from the bed 2. Alternatively, other latching or fastening means well-known in the art can be used. For simplicity, the latching mechanism is omitted from most of the remaining drawings in this disclosure.

The wheelchair 3 is shown in FIG. 1*b* locked in position at the foot-end of the bed 2 and in line with the person 1. The foot rest 14 has been raised by conventional methods and the backrest 13 lowered by means to be shown.

The height of the bed 2 is adjusted by use of the elevating mechanism 5 or other arrangement so as to place the top of the mattress 32 approximately level with the height of the chair seat 12.

Figure 1C:
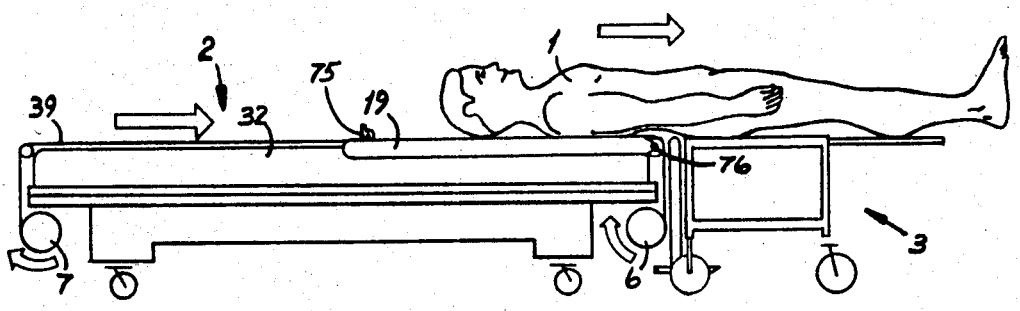

When roller 6 is driven in a clockwise direction, in a manner to be described, sheet 39 unwinds from roller 7 and moves to the right over the surface of mattress 32, carrying person 1 also to the right as depicted in FIG. 1*c*. When the person 1 has reached the position approximately as shown in FIG. 1*c*, the movement of roller 6 halts. At this point, the person 1 is resting partly on the wheelchair 3 and partly on the bed 2 and is ready to be lifted to a sitting position on the wheelchair 3.

Figure 1D:
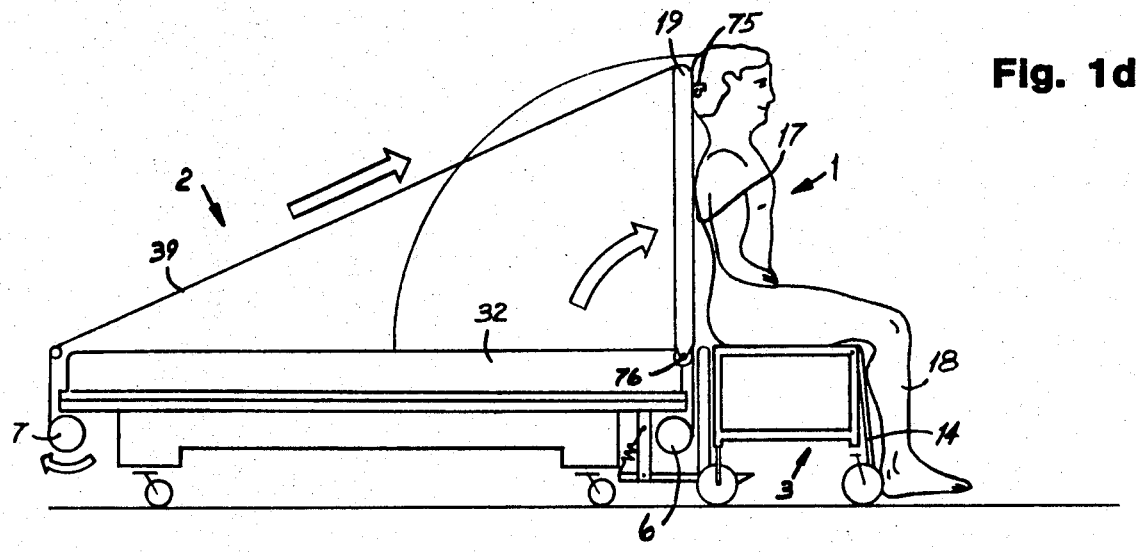

As shown in FIGS. 1*c* and 1*d*, the bed 2 is equipped with two parallel lift arms 19, one on each side of the bed, pivoted about a common axis 76. Each lift arm 19 is equipped with sheet support means, described subsequently, and an optional clamp 75 each of which, if used, is now tightened to securely grasp the edge of sheet 39. The lift arms are then driven together clockwise, as shown in FIG. 1*d*, to an essentially vertical position by a lift drive mechanism, to be described. The sheet 39, supported by the lift arms 19 is stretched between them and so lifts the person 1 to a sitting position. The legs 18 of the person 1 may also be lowered by releasing the foot support 14. As the lift arms 19 are raised, sheet 39 unwinds from roller 7 to provide the required slack.

Figure 1E:
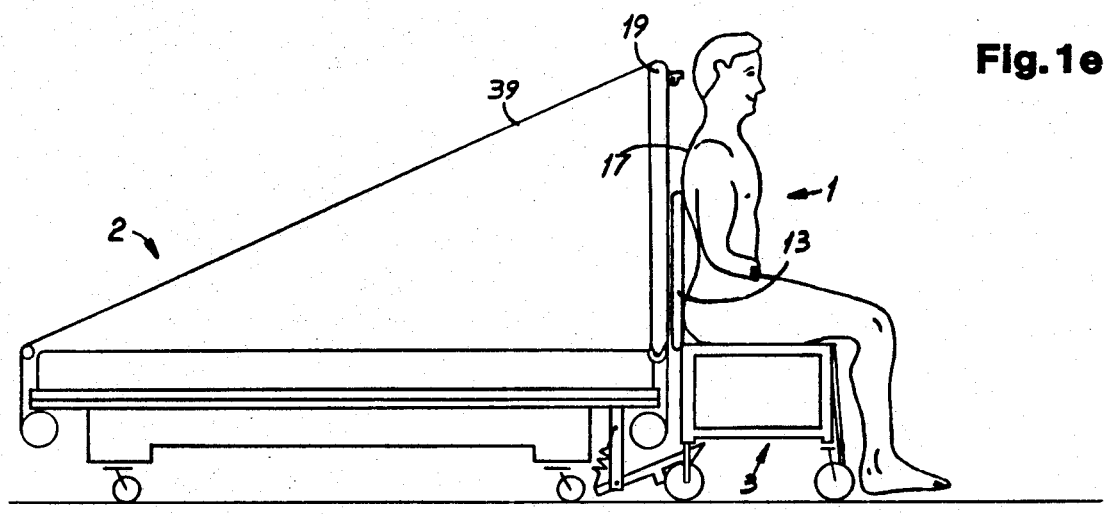
Figure 1F:
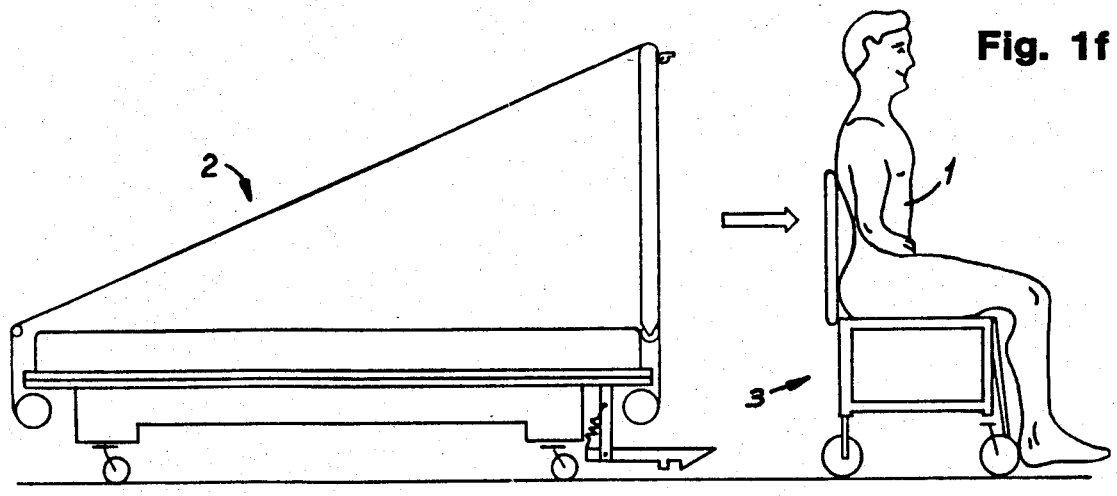

In FIG. 1*e*, the backrest 13 is raised, by means to be shown, between the person's back 17 and the sheet 39 which is supported by the lift arms 19, and thereby fully completing the transfer of the person 1 to the chair 3. The chair 3 may now be unlatched and moved, as required, with the person 1 thereon as indicated in FIG. 1*f*.

Figure 2:
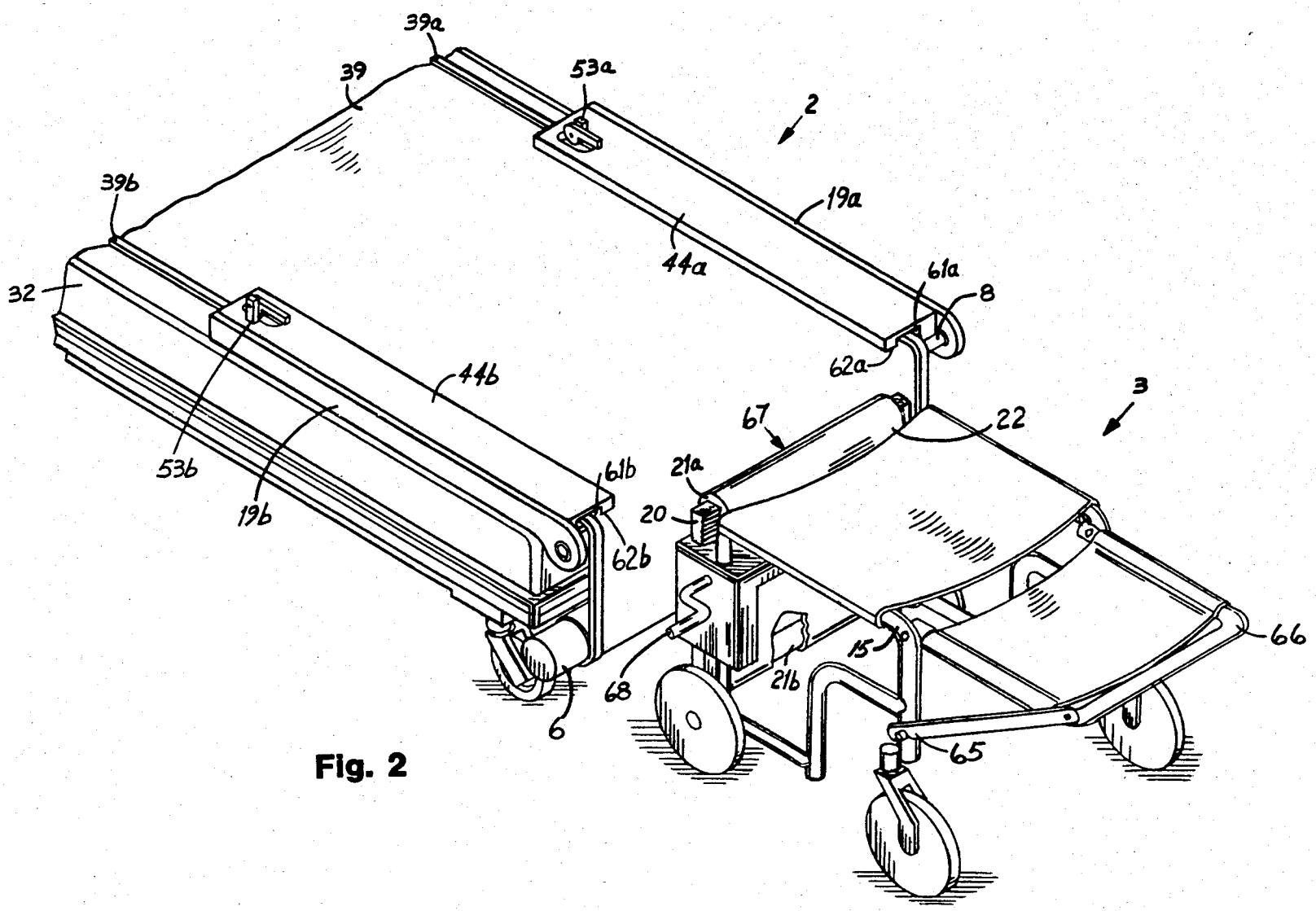
FIG. 2 is a partial perspective view of the invalid transfer arrangement showing one end of the bed equipped with a transfer sheet and rollers and a wheelchair, with the back retracted and leg rest raised, positioned at the end of the bed.

FIG. 2 is a simplified partial perspective view of the invalid transfer arrangement with a wheelchair 3 in position to receive a person, not shown, from bed 2.

A sheet 39 with thickened edges 39*a* and 39*b* is pulled over the mattress 32 and corner roller 8, by take-up roller 6 to which it is fastened. The supporting structure and means for driving these items, described subsequently, are omitted from FIG. 2 for clarity.

Figure 6:
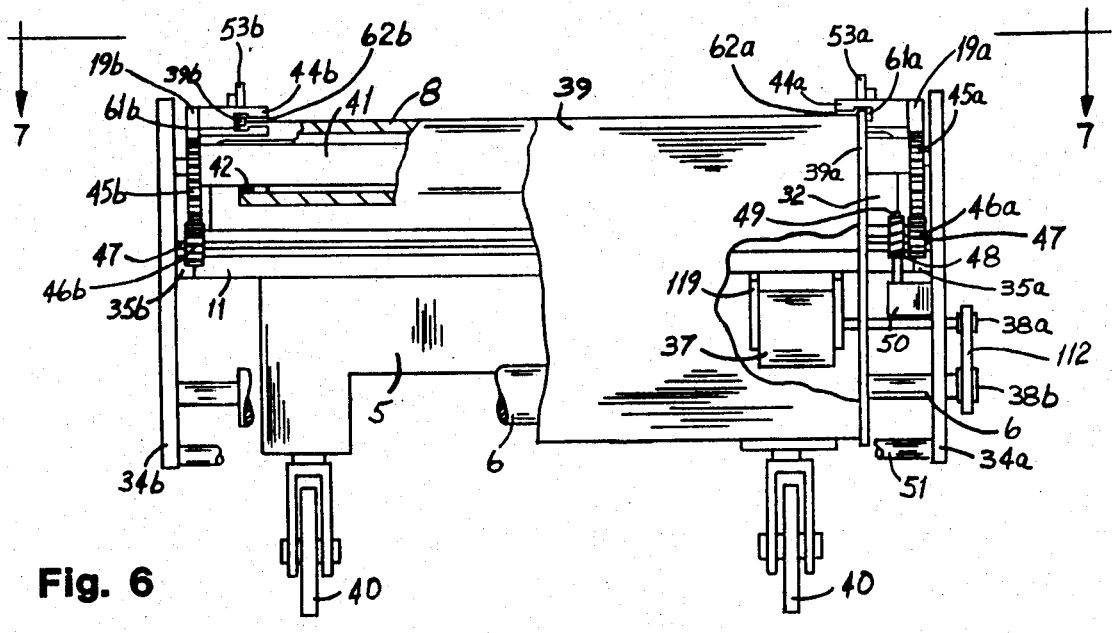
FIG. 6 is a partial end elevation view taken from FIG. 5 with some of the mechanism shown in section for clarity.

To aid in guiding the sheet 39, guidance members 44*a* and 44*b*, as also shown in FIG. 6, contain large internal grooves 61*a* and 61*b* through which the thickened edges 39*a* and 39*b* of sheet 39 slide freely and in which they are confined by the narrow outer portions or slits 62*a* and 62*b*. Through these slits only the thin body of the sheet 39 can slide, thereby guiding the sheet in its motion over the bed.

The guidance members 44*a* and 44*b* are fastened to and extend along lifting arms 19*a* and 19*b*, to guide the sheet over the bed and to support it when the lift arms are raised. Similar, but much shorter fixed guidance members (not shown) are mounted to the roller supporting structure near the head-end of the bed to guide the sheet over the head-end corner roller (not shown).

Initially, the supine person is transported so that the lower part of his body is on the wheelchair 3. Then the lift arms 19*a* and 19*b* are rotated about the axis of roller 8, as described subsequently, to raise sheet 39 and thereby the person's upper body resting thereon to an essentially vertical position, previously illustrated in FIG. 1*d*.

At this point, foot latch 65 may be released and foot rest 66 may be lowered.

To complete the transfer, the chair back rest assembly 67 is raised by rotating crank and shaft 68 on which two pinions (not shown) engage and drive up rack teeth on each vertical member of back frame 20, slidably mounted on wheelchair frame 15. When raised, the back is locked into position by means not shown.

Figure 3A:
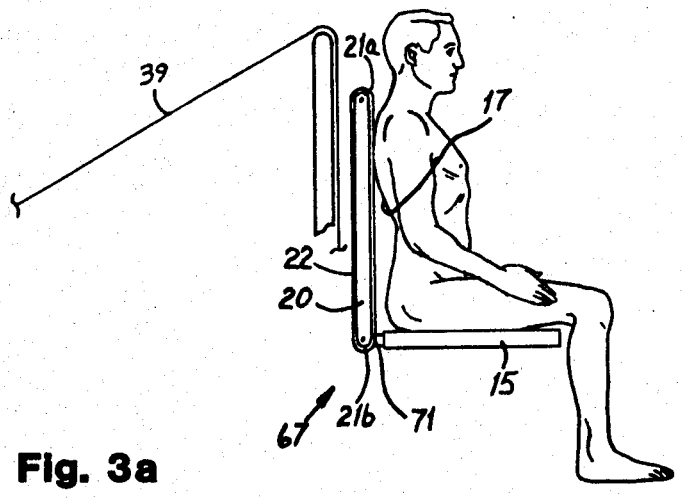
FIG. 3*a* is a schematic view showing a method of raising a wheelchair back support surface using idler rollers and an endless belt.

FIG. 3*a* is a schematic side view showing one design concept of the wheelchair back, when in its elevated position, between raised bed sheet 39 and the person's back 17. As shown in FIG. 2 and in schematic drawing FIG. 3*a*, the surface of back rest 67 comprises an endless belt 22 which passes around and is supported by rollers 21*a* and 21*b*, which are rotatably mounted to the top and bottom of frame 20, respectively. FIG. 3*a* shows the front side of belt 22 firmly attached to the fixed chair frame 15 at point 71, so that belt 22 cannot slide along the person's back 17. As frame member 20 is driven upward, the rear portion of belt 22 progressively passes over roller 21*a* and moves into a position behind and with no relative sliding motion along the person's back 17. The wheelchair back is locked in its top position by means not shown.

Figure 3B:
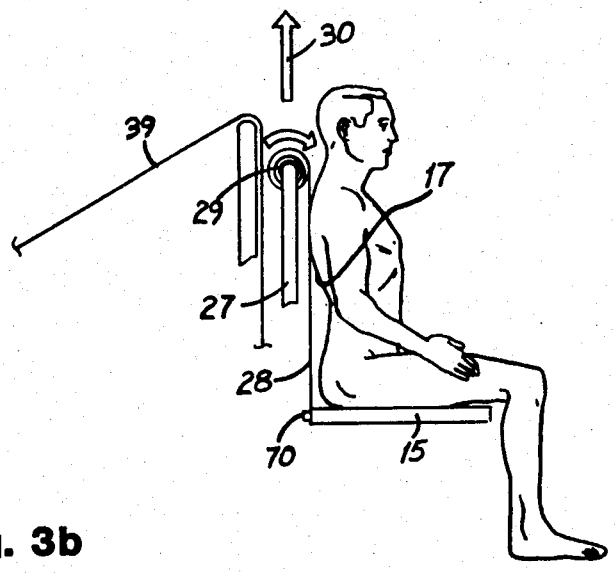
FIG. 3*b* is a schematic view showing another method of raising a wheelchair back support surface by unwinding a sheet of material from a moving storage roller.
Figure 4B:
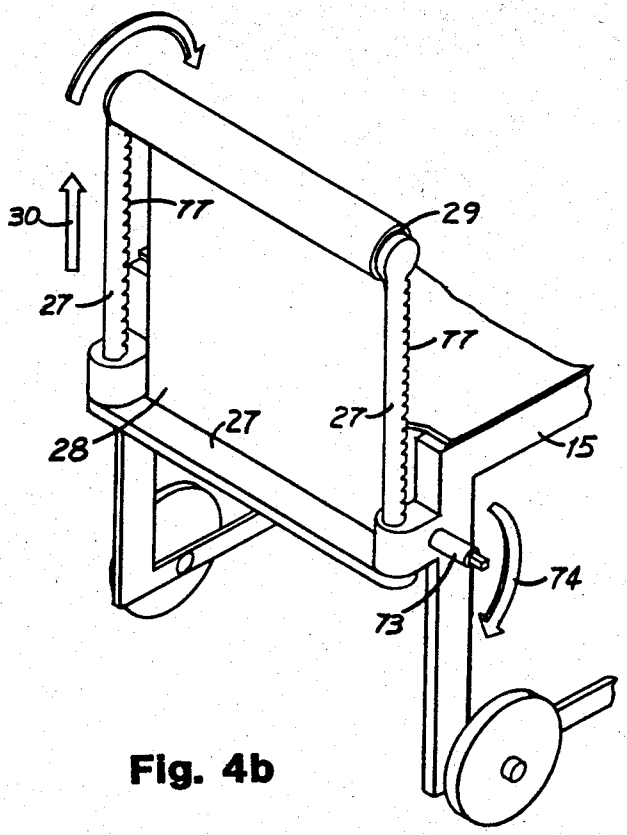
FIG. 4*b* is a partial perspective view of the wheelchair in FIG. 4*a* and shows the back raised.
Figure 4A:
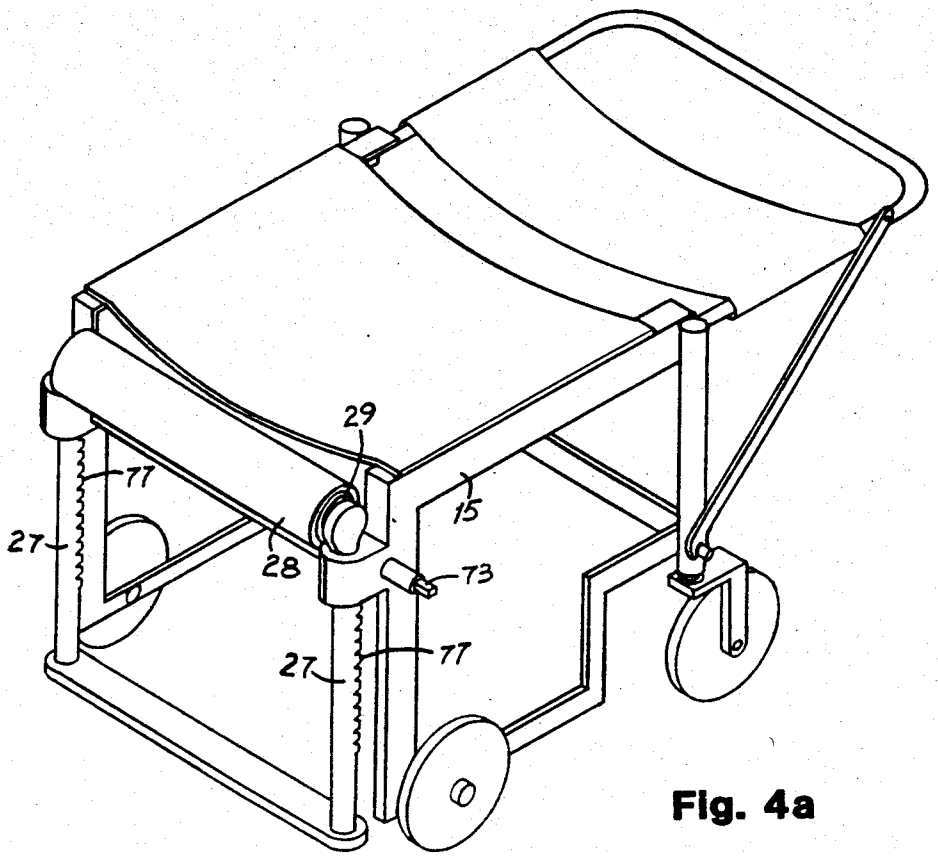
FIG. 4*a* is a perspective view of the wheelchair with the back retracted and showing a mechanism for raising the back.

Another method of achieving the same result is shown schematically in FIG. 3*b*, and in perspective in FIG. 4*a*, where the wheelchair's back is lowered. In a partial perspective view, FIG. 4*b* shows the wheelchair with the back raised to a normal position. The upper end of frame member 27 supports roller 29, which is analagous to a conventional window shade, in that a belt of flexible material 28 attached to the roller, is wound up around it by action of a spring or other means (not shown). The other end of belt 28 is fastened to the chair frame 15 at point 70 (shown only in FIG. 3*b*). Rotating shaft 73, as shown by arrow 74 (FIG. 4*b* only), rotates pinion gears (not shown) engaging racks 77 which are part of frame member 27 to drive it up as indicated by arrow 30. As frame member 27 rises, belt 28 unrolls from roller 29 and moves into position against the person's upper back 17 (as seen in FIG. 3*b*) with no rubbing or relative motion to cause discomfort or injury. When the frame 27 has been driven up to its full height, the belt 28 will have been unrolled and stretched tautly between the roller 29 and chair frame 15 so as to support a sitting person. It is then locked, by means not shown. Alternatively, a simple back with a fixed surface supported on a raisable frame may be used.

Figure 5:
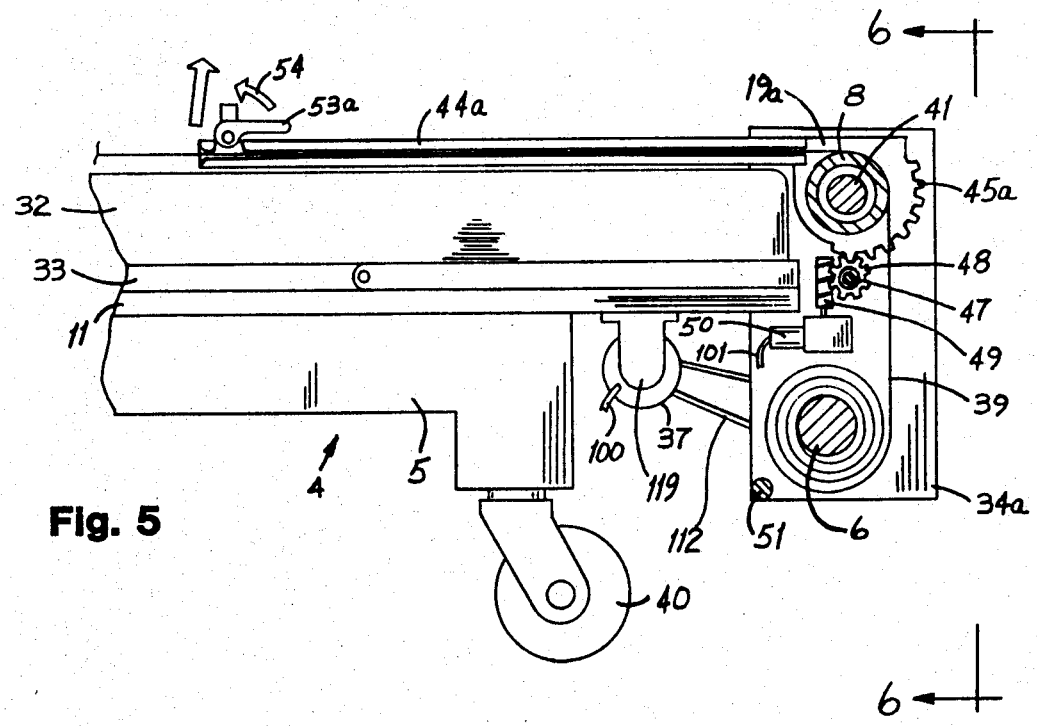
FIG. 5 is a partial side elevation view of the bed arrangement showing, in section, the mechanical construction of the sheet drive and lifting arms.
Figure 7:
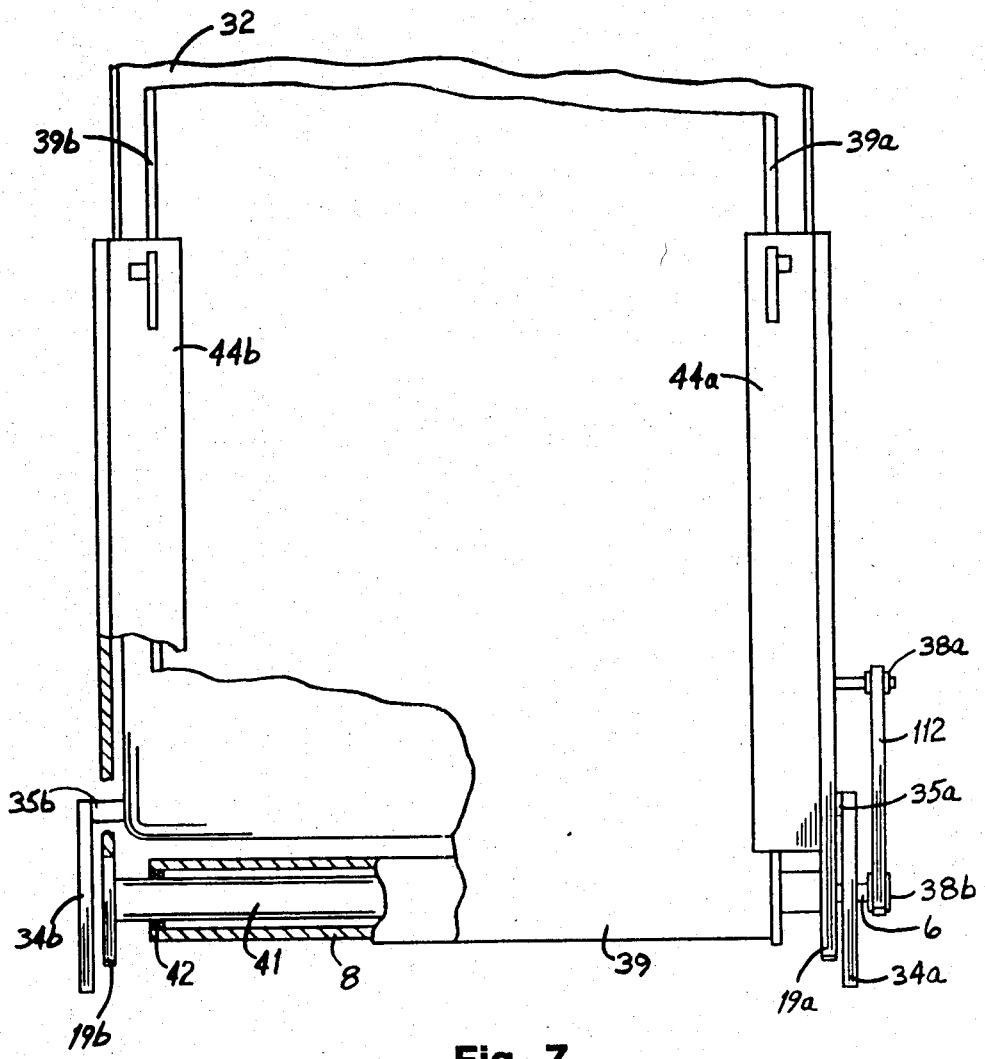
FIG. 7 is a partial plan view taken from FIG. 6 with some of the mechanism shown in section for clarity.

FIGS. 5, 6 and 7 are partial cross-sectional side elevation, end elevation and plan views of the foot-end of the bed, showing the arrangement of the transport and lift arm mechanisms. The conventional hospital type bed consists of an elevating mechanism 5 supporting a fixed frame 11 to which an articulated frame 33 is attached, and on top of which is the mattress 32. All of this is supported by castered wheels 40. Supporting the lifting and transport mechanisms are left and right (as seen from a patient's position in bed) side plates 34*a* and 34*b* connected by cross member 51 and suitably attached through supporting spacer blocks 35*a* and 35*b* to bed frame member 11.

Supported between side plates 34*a* and 34*b* by bearings, not shown, is takeup roller 6. As shown in FIGS. 6 and 7, and in FIG. 5, which is a side elevation view of the bed with a partial section taken through the lifting and driving mechanism to show details of operation, roller 6 is driven by motor drive 37. The latter is a reversible motor with speed reducer and optional clutch, through pulley 38*a*, belt 112, and pulley 38*b* which is firmly attached to take-up roller 6. The motor drive 37 is fastened to frame member 11 by adjustable bracke 119.

Sheet 39, which is wrapped around and fastened to roller 6, passes over corner roller 8, through guidance members 44*a* and 44*b*, over the mattress 32 to the other end of the bed, not shown, and to a similar arrangement of corner guidance members, corner roller and take-up roller. Corner roller 8 rotates coaxially about axle 41 in bearings 42. Axle 41 rotates in bearings, not shown, in side plates 34*a* and 34*b*. Rigidly fastened to axle 41 are lift arms 19*a* and 19*b*. These arms extend along the sides of the bed and on them are mounted guidance members 44*a* and 44*b* which contain internal grooves 61*a* and 61*b* to guide and support the thickened sheet edges 39*a* and 39*b*, and slits 62*a* and 62*b* through which the center portion of the sheet 39 slides. (For simplicity, the thickened edge 39*a* of sheet 39 is not shown in side view FIG. 5, and sheet 39 is indicated by a single line.)

On the arms 19*a* and 19*b* and concentric with axle 41, are gear segments 45*a* and 45*b*. The gear segments 45*a* and 45*b* mesh, respectively, with pinions 46*a* and 46*b*. These pinions are on a common shaft 47 supported by bearings (not shown) in sideplates 34*a* and 34*b*. This shaft 47 has an attached worm gear 48 in mesh with worm 49, which is driven by motor drive 50, mounted on sideplate 34*a*, to raise the lift arms.

To transport a person to the right in FIG. 5, as previously illustrated in FIG. 1*c*, foot-end motor drive 37 rotates roller 6 in a clockwise direction to pull sheet 39 across the bed, while the head-end motor/clutch drive pays out the sheet or allows it to be drawn out at the head end of the bed, not shown in FIGS. 5, 6, and 7.

As the person reaches the proper location for transfer to a seated or standing position the motor drive 37 driving sheet 39 is stopped. At this point, optional over-center locks 53*a* and 53*b* are rotated as shown by arrow 54 to lock the sheet edges 39*a* and 39*b* in guidance members 44*a* and 44*b*, respectively. Alternatively, these locking means may be omitted. Lift motor 50 is then actuated to rotate worm 49 engaging worm gear 48 on shaft 47. To this shaft are attached gears 47 meshing with sector gears 45*a* and 45*b* on lift arms 19*a* and 19*b* for raising these lift arms and sheet 39, so as to move the person to a sitting position as shown previously in FIG. 1*d*, with sheet 39 being paid out from the head-end roller.

To return the person to a supine position, or to lower the lift arms, motor 50 is actuated to run in the opposite direction, and the motor drive head-end transport is actuated to take up the slack in sheet 39.

Figure 5A:
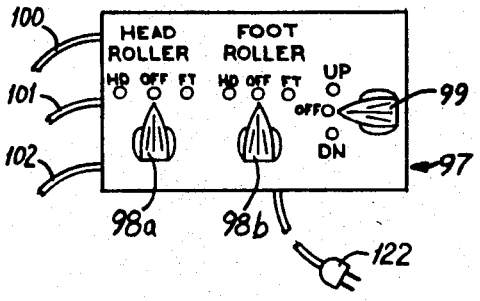
FIG. 5*a* is a front view of the control box.

FIG. 5*a* is a front view of the electrical control box 97. It connects to a power source through cable 122, and to both transport motor drives (only one of which is shown) and lift motor drive 50, through electrical cables 102, 100 and 101, respectively. Transport controls 98*a* and 98*b* are spring-centered switches, normally off, which, in conjunction with logic and control circuitry well known in the art, actuate the transport drives to drive in either direction. Similarly, lift control 99 is also a spring-centered switch which actuates the lift drive in either direction.

If optional electrically actuated clutches are included in the transport motor drives, a single such transport control switch is used to actuate either transport motor drive to wind up the sheet on its respective roller and to dis-engage the opposite-end clutch so as to allow the sheet to be drawn off the opposite-end roller.

Figure 6A:
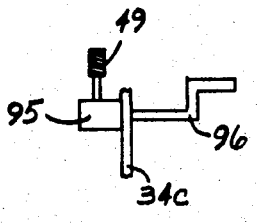
FIG. 6*a* is a partial front view of a hand crank lifting drive.

FIG. 6*a* is a front elevation view of parts of the bed showing an alternate hand-crank drive for the lift arms in place of motor drive 50 shown in FIGS. 5, 6, and 7. For the hand-crank embodiment of the invention, motor drive 50 in FIG. 6 is replaced by gear box 95 containing a socket to mate with hand crank 96. The latter passes through a hole in side plate 34*c*, which is otherwise identical to side plate 34*a* of FIG. 6.

Similarly, hand-crank drives can be used for the transport rollers in place of the motor drives shown in FIGS. 5, 6, and 7.

Figure 8:
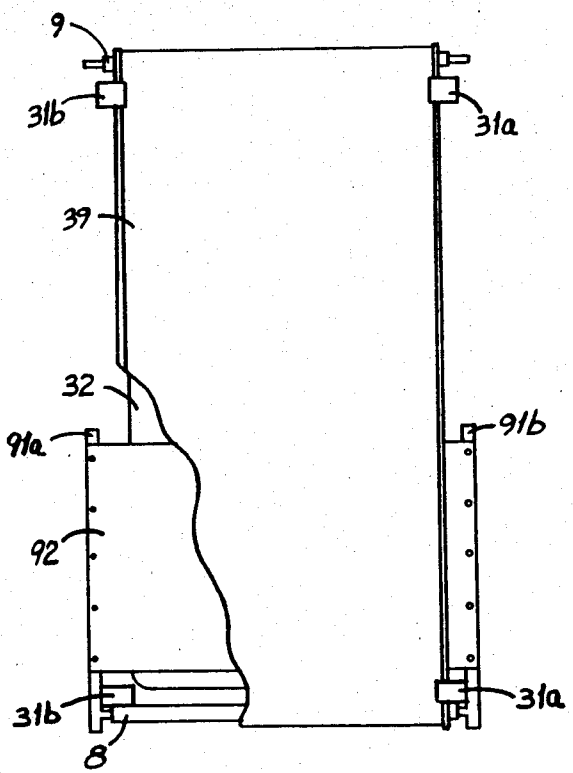
FIG. 8 is a schematic plan view of a lifting sheet arrangement for raising a person.

FIG. 8 is a schematic plan view of the bed showing another embodiment of the invention in which a transverse lift sheet 92 passes between transport bed sheet 39 and mattress 32, and is fastened to and stretched between lift arms 91*a* and 91*b*. Lift arms 91*a* and 91*b* are similar to lift arms 19*a* and 19*b* of FIG. 7, except that greatly shortened guidance members 31*a* and 31*b* are used. In FIG. 8, these shortened guidance members 31*a* and 31*b* are also shown schematically at the opposite end of the bed to guide the sheet 39 uniformly over corner roller 9.

When lift arms 91*a* and 91*b* are rotated, as illustrated previously in FIGS. 1*d* and 1*e*, transverse lift sheet 92 raises sheet 39 and a supine person thereon (not shown). This arrangement is usable with the drive mechanisms shown in FIGS. 5, 6, 6*a* and 7.

Figure 9:
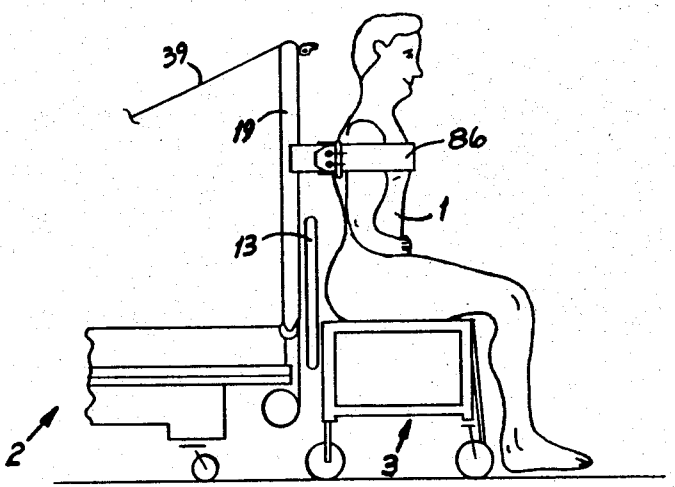
FIG. 9 is a schematic side view of a person strapped to the lifting arms, seated on the wheelchair, as the back is being raised.

FIG. 9 is a schematic side view of a person being transferred to a wheelchair. The person 1 has been raised to a seated position on wheelchair 3 as in FIG. 1*d*, except that if he is leaning forward, he will be supported by safety support 86, removably attached to lift arms 19.

Figure 10:
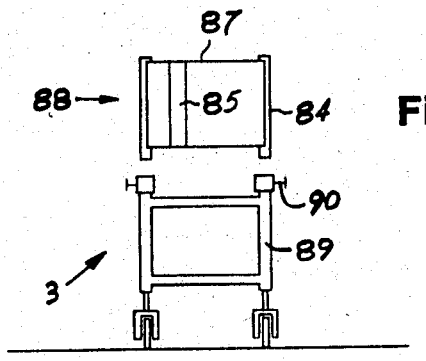
FIG. 10 is a schematic plan view showing a simple removable wheelchair back.

FIG. 10 is a schematic back view of a wheelchair 3 with a detachable back 88 which fits into sockets with locking thumb screws 90 on frame 89. This wheelchair and back arrangement is another embodiment which can be used in place of elevating back structures, shown previously. Alternatively, the flexible wheelchair back surface 87 is detachable from one of two wheelchair back support members 84 by a zipper 85, for example. After a person has been transferred to the wheelchair in an upright position, the detachable end of the flexible back surface is re-attached to provide back support.

Figure 10A:
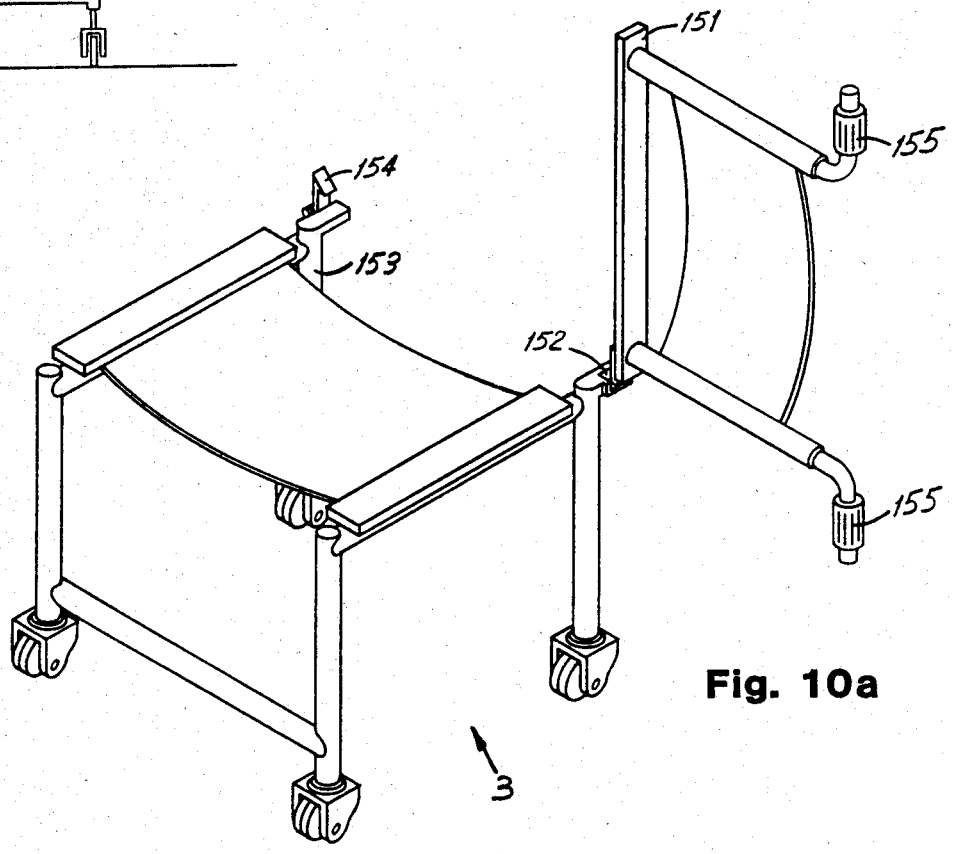
FIG. 10*a* is a perspective view of a wheelchair showing a hinged back.

FIG. 10*a* is a perspective view of the wheelchair 3 showing a further embodiment of this invention. The back frame 151 is attached by hinge 152 to a frame member 153 of wheelchair 3. During transfer of a person to wheelchair 3, the back is folded to one side as shown. After the person is seated on wheelchair 3, back frame 151 is folded over to its normal position and secured there to frame member 153 by latch 154. The handles 155 are rotatably attached to back frame 151, so that they can be twisted from their normal positions in which they extend backwards, to extend sidewards, as shown, in order to slide easily between the person's back and the support sheet behind him when he is seated as shown in FIG. 1*d*.

Figure 10B:
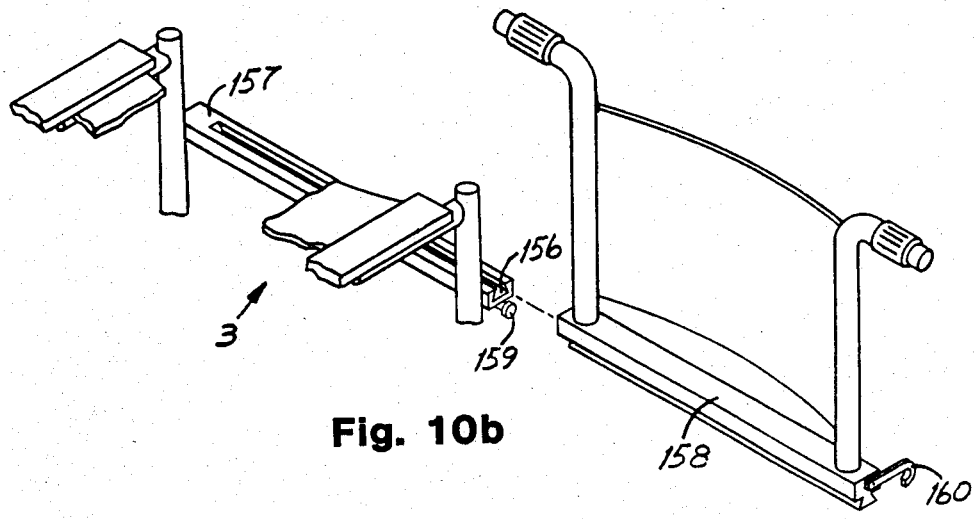
FIG. 10*b* is a partial perspective view of a wheelchair with a slidable back.

FIG. 10*b* is a partial perspective view of a different arrangement of wheelchair 3, in which back frame member 158 fits and slides into a groove 156 in wheelchair frame member 157. It is secured there by the manually rotating latch 160 which engages member 159.

Figure 11:
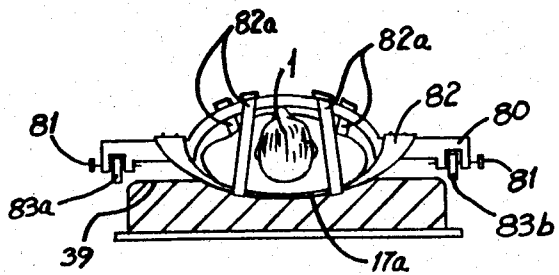
FIG. 11 is a schematic end elevation view of a cross-brace arrangement for raising a person.

FIG. 11 is a partial schematic end view showing still another embodiment of the invention in which a person is raised without lifting the sheet 39. In this arrangement, a crossbrace 80 is removably attached to lift arms 83*a* and 83*b* by fasteners 81, which are shown as removable pins but which can have many other forms. The person 1 is attached to the lifting arms by a flexible lifting support 82 comprising a band of flexible material slipped under the person's shoulders and neck 17*a* and removably attached, by straps 82*a* to the crossbrace 80. Alternately, it may be attached to the lift arms 83*a* and 83*b*. Raising lift arms 83*a* and 83*b* lifts the person comfortably to a seated or a standing position. The crossbrace 80, if used, is preferably made stiff in order to greatly reduce the horizontal bending forces on the lift arms and thereby their required weight.

Figure 12A:
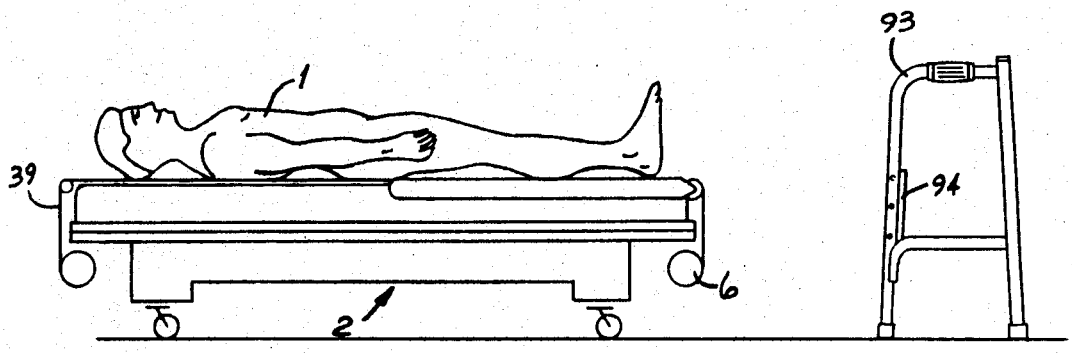
FIGS. 12*a* through 12*c* are schematic sequenced views showing the operation of the invention in transferring a person from a supine position on a bed, to a standing position on the floor.
Figure 12B:
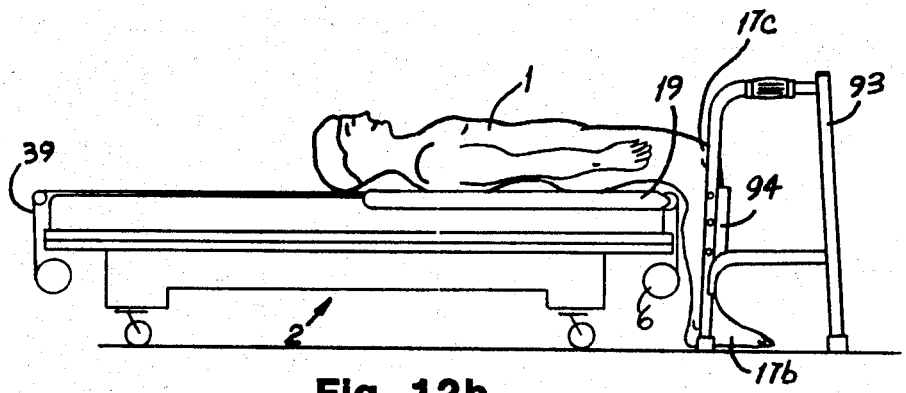
Figure 12C:
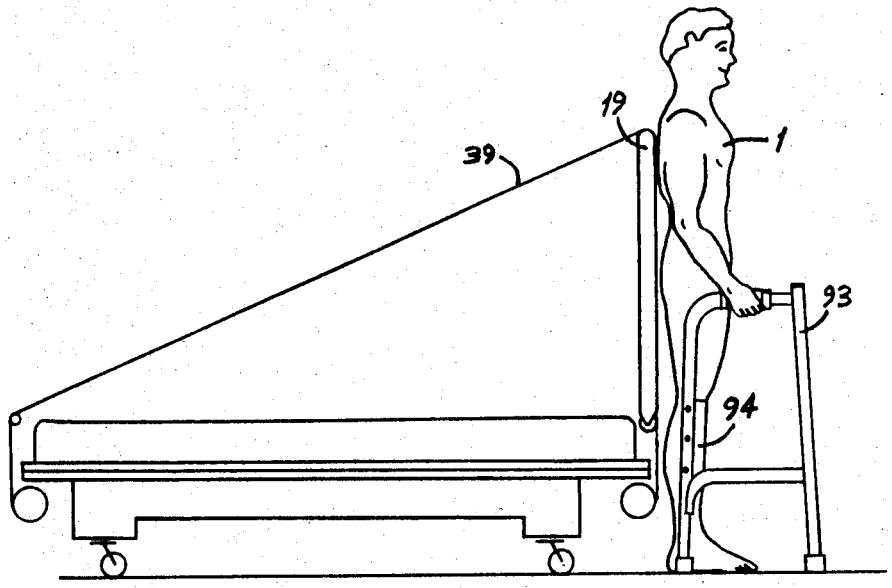

FIGS. 12*a* through 12*c* are schematic sequenced views showing the transfer of a person to a standing position at a walker 93.

FIG. 12*a* shows the person 1 recumbent on the bed 2 ready for transfer.

FIG. 12*b* shows the person 1 after he has been moved to the end of the bed 2, by the motion of the sheet 39 over the bed, as described earlier. At this point, with the person's feet 17*b* on the floor, the drive of the foot-end roller 6 is stopped. The invalid walker 93, equipped with knee brace 94, is then moved to the end of the bed, with knee brace 94 placed as a support for the person's knees. (Alternatively, a wheelchair or other device equipped with a knee brace structure can be used.) The lift drive mechanism is then activated to rotate the lift arms 19, which raise the sheet 39 and the person 1, at the end of the bed 2, to a standing position, as shown in FIG. 12*c*. The knee brace structure 94 supports the person's knees 17*c* so that they straighten instead of buckle as the person is moved forward and upward by the lift arms 19 and sheet 39. During this process, the walker 93 is preferably held fixed by an attendant or by a latch. To use the walker, the knee brace 94 is removed by unfastening it or folding it away. Alternatively, the knee brace support can be fastened to the front or side edge of the walker and the walker turned around so that the knee brace support is close to the end of the bed. After the person is in a standing position, the walker can be returned to its normal position for use by the person.

Figure 13:
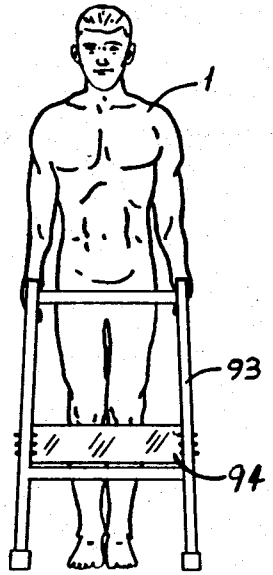
FIG. 13 is a front schematic view of an invalid walker equipped with a knee brace.

FIG. 13 is a schematic front view of the person 1 and walker 93, showing the knee brace 94.

There are known a number of methods of fabricating a thickened edge on a sheet. Front sectional FIGS. 14*a*, 14*b* and 14*c* show an additional method, with the associated guidance support.

Figure 14A:
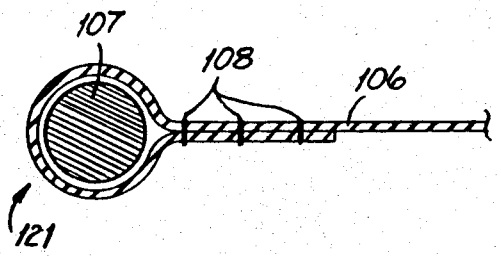
FIG. 14*a* is a front sectional view of a sheet hemmed around a rope.

FIG. 14*a* shows a rope 107 or other circular or near circular flexible member enveloped by the edge of sheet 106 that has been folded over on itself, and fastened together by stitching 108 to form a thickened edge with a near-circular cross section 121. A similar edge is formed on the opposite side of the sheet 106.

Figure 14B:
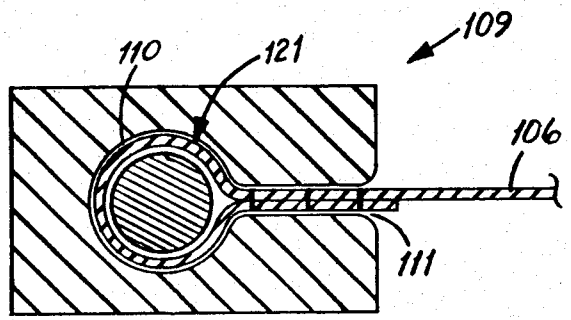
FIG. 14*b* is a front sectional view of a guidance member for the sheet in FIG. 14*a;*
Figure 14C:
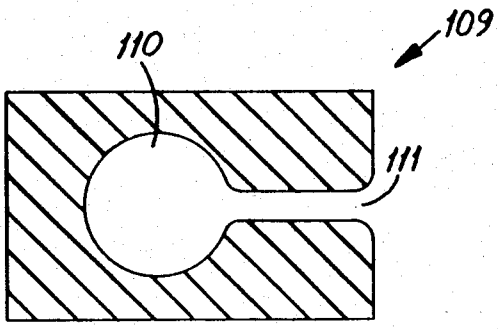
FIG. 14*c* is a front sectional view of the sheet of FIG. 14*a* in its normal position, supported within the guidance member of FIG. 14*b;*

FIG. 14*b* shows guidance members 109, similar to members 44*a* and 44*b* in FIG. 2, except that members 109 contain inner grooves 110 of near-circular cross section along which the near-circular cross-section edges 121 of sheet 106 fit and slide, as shown in FIG. 14*c*. They contain narrow outer slits 111 along which the body of sheet 106 can slide. Since the thickened edges 121 are too thick to pass through slits 111, the guidance members 109 control the position of sheet 106 when it is pulled over the bed. They support the sheet when the guidance members 109 are lifted to raise a person.

Figure 15:
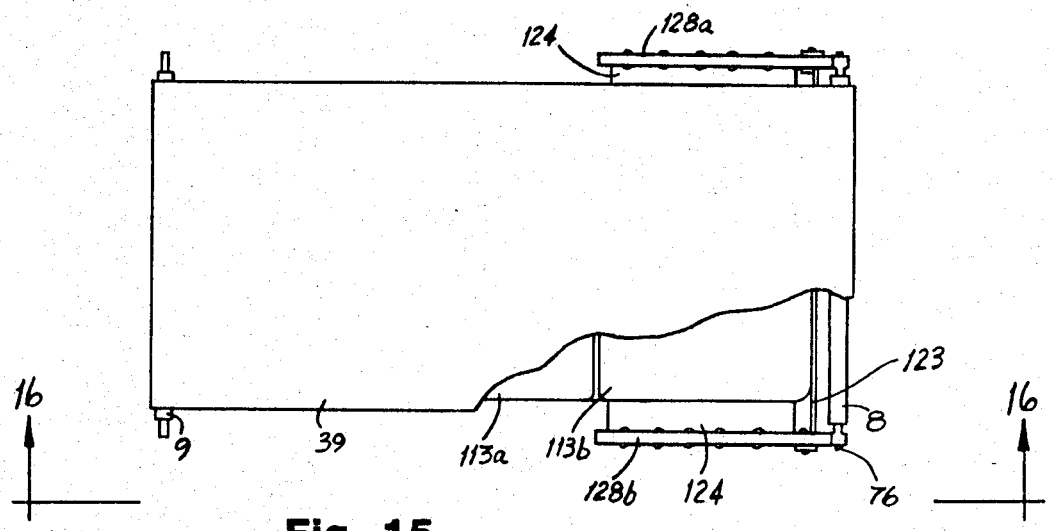
FIG. 15 is a schematic plan view of a bed with lift arms to raise a portion of the mattress.
Figure 16:
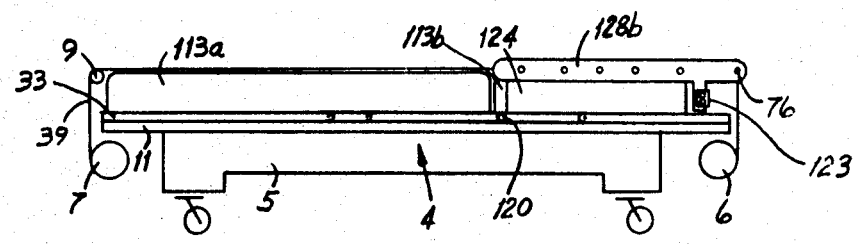
FIG. 16 is a side elevation view of the bed in FIG. 15.
Figure 17:
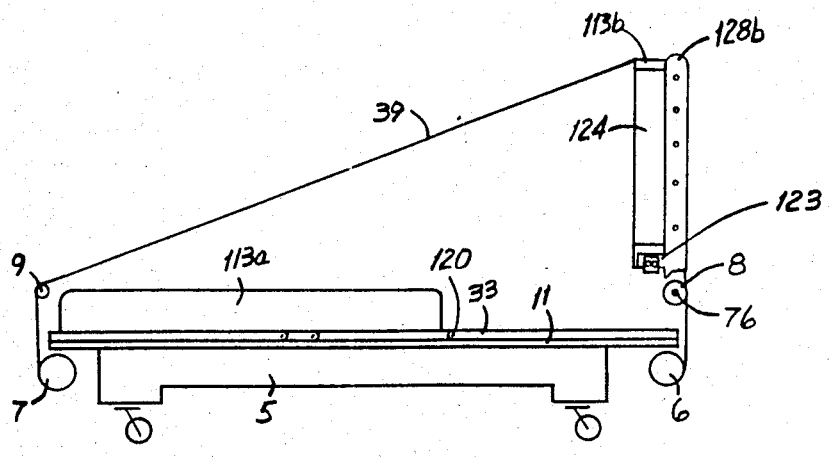
FIG. 17 is a side elevation view, of the bed in FIG. 15, showing the mattress raised.

FIG. 15 is a schematic plan view, and FIGS. 16 and 17 are schematic side elevation views showing a different embodiment of the present invention wherein the person is raised by raising part of the mattress, which is divided into two sections, the head section 113*a* and foot section 113*b*. The division is made near the lowest joint 120 in the articulated bed frame member 33 so as to not interfere with the normal operation of the bed. A lifting member 124 consisting of a sheet of flexible material is fastened to both lift arms 128*a* and 128*b*, and extends between them under the foot section of the mattress 113*b*, with enough slack for the articulated foot section of a hospital type bed to be elevated without interference, during normal operation of the bed. When raised, mattress section 113*b* is supported by brace 123 attached to lift arms 128*a* and 128*b*.

FIG. 17 shows lift arms 128*a* and 128*b* rotated about pivot axis 76 to raise member 125 and mattress section 113*b* to a near-vertical position in such a way, as to raise a person to a seated position in a wheelchair or a standing position on the floor, as illustrated previously in FIGS. 1*d* and 12*c*. Alternatively, a conventional mattress can be used in place of the divided mattress 113*a* and 113*b*.

The lift arms 128*a* and 128*b* of FIG. 16 can be constructed in such a way, that they are integrated with, become part of, or replace part of the articulated frame 33 of the bed, and they may be driven by a screw jack as is commonly used in articulated hospital beds. There is no intent to limit the present invention to the types of lift arm and lift arm drives described earlier and shown in FIGS. 2, 5, 6, 7, and 8.

Figure 18:
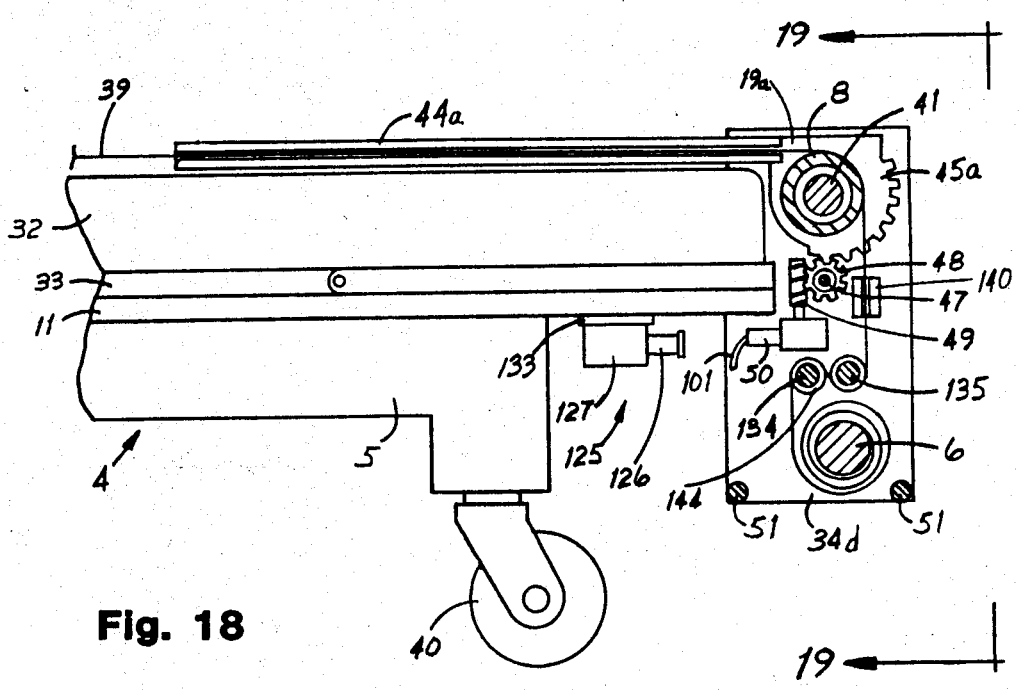
FIG. 18 is a partial side elevation view of a bed arrangement showing in section the mechanical construction of a pinch roller sheet drive, separate storage roller, and lifting arm.
Figure 19:
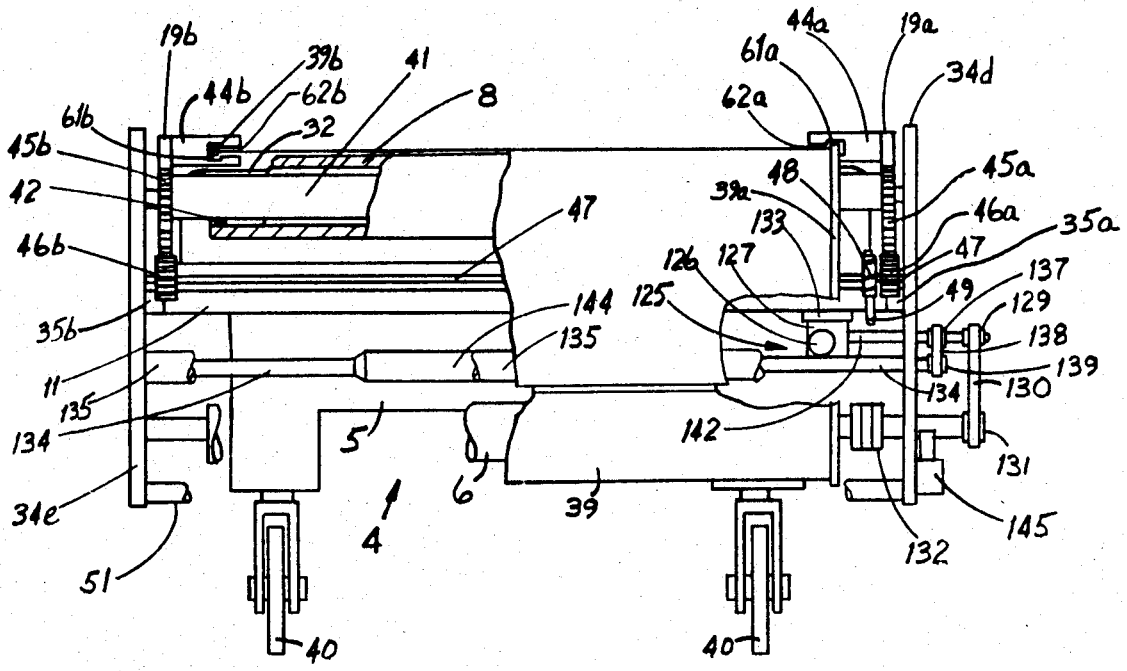
FIG. 19 is a partial end elevation view taken from FIG. 18 with some of the mechanism shown in section for clarity.
Figure 20:
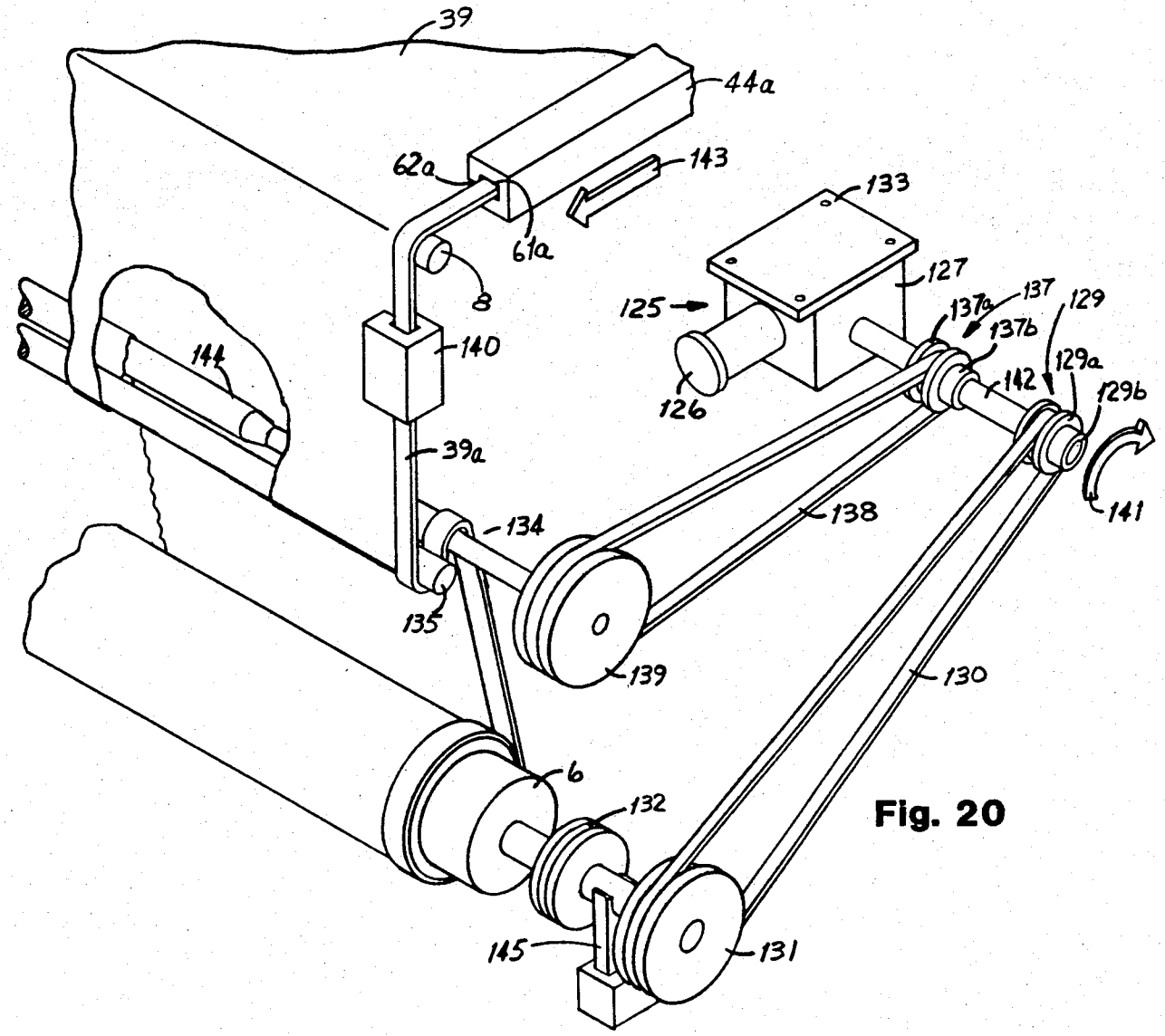
FIG. 20 is a partial perspective view of the pinch roller sheet drive as shown in FIG. 18.

FIGS. 18, 19, and 20 show an alternative transport sheet drive arrangement, using drive and pinch rollers, in addition to a corner roller and driven wind-up roller.

To transport a person to the right as illustrated in FIG. 1*c*, the sheet 39 must be moved to the right. To do this, the drive system must apply enough force to pull the sheet with a person thereon smoothly across the mattress. In addition, the sheet 39 must be wrapped or rolled up for storage at one end of the bed and paid out, or freely drawn off a roller, at the other end of the bed. When the sheet is not being driven, its tension should be maintained so that it is not free to unwind and bunch under the person, causing discomfort.

During adjustments, such as raising the head or knee sections of a hospital-bed mattress, which are normally carried out, the sheet from the appropriate roller must be slackened to allow it to unwind and move with the mattress; however, when the bed adjustment has been completed, the sheet tension should be restored so as to support a person on the mattress without sliding. When the lift arms raise the person to a sitting or standing position, the sheet from the appropriate roller must again be slackened to accommodate the motion.

FIG. 18 is a side view of the bed with partial section taken through the lifting and driving mechanism to show details of operation. FIG. 19 is a partial cross-sectional front elevation view showing the arrangement of the transport and lift arm mechanisms mounted on a conventional hospital type bed 4. Parts of the drive and lift mechanisms have been deleted from FIGS. 18 and 19, for clarity. FIG. 20 is a schematic perspective of the sheet drive only, with the rest of the bed omitted for clarity.

As shown in FIGS. 18 and 19, the conventional hospital type bed 4 consists of an elevating mechanism 5 supporting a fixed frame 11 to which an articulated frame 33 is attached and on top of which is the mattress 32. All of this is supported by castered wheels 40. Supporting the lifting and transport mechanisms are left and right (as seen from a patient's position in bed) side plates 34*d* and 34*e* connected by cross members 51, and suitably attached through supporting brackets 35*a* and 35*b* to frame member 11.

Supported between side plates 34*d* and 34*e* by bearings, not shown, is take-up roller 6. As shown, roller 6 is driven by drive unit 125 comprising a reversible motor 126 with speed reducer 127. Drive unit 125 propels take-up roller 6, through pulley-clutch 129 comprising overrunning clutch 129*b* and pulley 129*a*, belt 130, pulley 131, and slip clutch 132. The drive unit 125 is fastened to frame member 11 by adjustable bracket 133.

Also supported between side plates 34*d* and 34*e* by bearings, not shown, are drive roller 134 and pinch roller 135. Drive roller 134 is also propelled by drive unit 125 through pulley-clutch 137 comprising overrunning clutch 137*b* and pulley 137*a*, belt 138 and pulley 139.

As shown in FIGS. 18, 19 and 20, sheet 39, which is wrapped around and fastened to storage roller 6, passes over drive roller 134 and under pinch roller 135. The surface layer 144 of drive roller 134 is somewhat flexible and has a high coefficient of friction to enable it to propel the sheet 39, which is compressed betweeen pinch roller 135 and drive roller 134. The sheet 39 then passes through guidance member 140, over corner roller 8, through guidance members 44*a* and 44*b*, over the mattress 32, to the other end of the bed, and to a similar arrangement of guidance members, corner roller, pinch and drive rollers and a take-up roller. (In FIG. 19, guidance member 140 is not shown for clarity.) Corner roller 8 rotates coaxially about axle 41 in bearings 42. Axle 41 rotates in bearings in side plates 34*d* and 34*e*. Rigidly fastened to axle 41 are lift arms 19*a* and 19*b*. These arms extend along the sides of the bed 4 and mounted to them are guidance members 44*a* and 44*b* which contain internal grooves 61*a* and 61*b* to guide and support the thickened sheet edges 39*a* and 39*b*, and slits 62*a* and 62*b* through which slides the center portion of the sheet 39.

As shown in FIGS. 18 and 19, the arms 19*a* and 19*b* include gear segments 45*a* and 45*b*, concentric with their axle 41. The gear segments 45*a* and 45*b* mesh, respectively, with pinions 46*a* and 46*b*, which are on a common shaft 47 supported by bearings in sideplates 34*d* and 34*e*. This shaft 47 has an attached worm gear 48 in mesh with worm 49, which is driven by motor drive 50, mounted on sideplate 34*d*, to raise or lower said lift arms.

In FIGS. 19 and 20 are shown pulley-clutch units 129 and 137 which contain, respectively, overrunning clutches 129*b* and 137*b*. These units are commercially available and well known in the art. They may be of the wrapped spring, ratchet, or any other type. They are arranged in FIG. 20 so that when the output shaft 142 from speed reducer 127 rotates clockwise, as shown by arrow 141, the clutches 129*b* and 137*b* drive the pulleys 129*a* and 137*a* respectively in a clockwise direction. If the shaft 142 rotates counterclockwise relative to these pulleys, only negligible torque will be transmitted to said pulleys. In addition, the pulleys 129*a* and 137*a* may rotate freely clockwise relative to the shaft 142 thereby transmitting negligible torque to said shaft. In a counterclockwise direction, however, they will be locked to and will transmit torque to shaft 142.

To drive sheet 39 in the direction of arrow 143, motor 126 is actuated to rotate shaft 142 clockwise, which drives rollers 134 and 6 clockwise. For the sheet to be taken up properly on roller 6, the various drive pulley and roller diameters are selected so that in the absence of a sheet 39, the surface velocity of wind-up roller 6 exceeds that of drive roller 134. As a result, a sheet 39 driven by rollers 134 and 135 puts a retarding torque on windup roller 6 and causes clutch 132 to slip. The sheet will then be wound up on roller 6 with no slack, and with a tension determined by the slip torque setting of clutch 132.

To lock the sheet 39 in place so that it cannot be drawn through the drive and pinch rollers 134 and 135, and thus off roller 6, motor 126 is stopped. A gear train which has high frictional resistance to back driving, such as a worm gear drive, is used in speed reducer 127, so that with the motor 126 stopped, shaft 142 is effectively locked. Then, overrun clutch 137*b* will prevent any counterclockwise rotation of pulley 137*a*, and thereby of roller 134. This will secure the sheet 39 from being drawn from roller 6.

To allow sheet 39 to be drawn off roller 6, motor 126 is driven in the reverse direction so that shaft 142 rotates counterclockwise. When driven in this direction overrun clutches 137*b* and 129*b* will slip and will not transmit appreciable torque to rollers 134 and 6. These rollers can then rotate freely in either direction, and sheet 39 can be drawn through the drive and pinch rollers 134 and 135 and off roller 6. The only limitation here is that pulley 137*a* cannot rotate counterclockwise faster than shaft 142. To prevent friction torque through overrunning clutch 129*b* from causing roller 6 to unwind, added friction is provided by a small drag brake 145 between pulley 131 and slip clutch 132.

Figure 21:
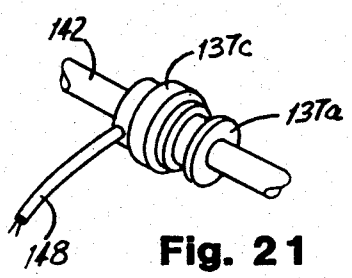
FIG. 21 is a front elevation view of an electrically actuated clutch used in an alternate embodiment of the drive shown in FIG. 20.

In an alternative embodiment, overrunning clutch 137*b* is replaced on shaft 142 by an electrically actuated clutch 137*c* as shown in FIG. 21, and clutch 129*b* and brake 145 are deleted. To draw the sheet 39 across the bed and wind it on roller 6, motor 126 is actuated with clutch 137*c* engaged, driving roller 134 through pulley 137*a* and roller 6 through pulley 129*a*, as described above. To secure the sheet, motor 126 is stopped, and clutch 137*c* is engaged. To allow the sheet 39 to be drawn off roller 6, clutch 137*c* is dis-engaged. Clutch 132 then slips and roller 6 unwinds when the pulling torque from the sheet exceeds the slip torque of the clutch. Clutch 137*c* is electrically connected by cable 148 to control circuits, not shown, but well known in the art, which cause the clutch to be engaged or disengaged.

A supine person presents an uneven weight distribution across the width of a bed. As a result, when a sheet is pulled uniformly across its width, some portions of the sheet where the load is greatest stretch more than others. For this reason, it has been found desirable to pull the central portion of the sheet where the load is greatest. It is a specific object of the present invention to provide a drive and pinch roller structure as described herein to produce the principal pulling force along the central portion of the sheet.

To accomplish this, as shown in FIGS. 19 and 20, the surface 144 of drive roller 134 is preferably cut away or relieved toward the ends of roller 139. This will provide driving friction between sheet 39, the roller surface 144, and pinch roller 135 where needed to optimize the tension distribution across sheet 39 and minimize sheet bunching and wrinkling.

Similarly, and for the same reasons, head-end roller 7 and corner roller 9 shown in FIG. 1*a* and the foot-end roller 6 and corner roller 8 shown in FIGS. 1*a* and 2 are preferably also cut away to smaller diameters toward their ends.

I claim:

1. An invalid transfer arrangement comprising: a bed having opposite ends, a mattress with sides and foot-end, a bed frame, and legs; a wheelchair adjacent to said bed with seat level with the top of the mattress; transport means including rollers at said opposite ends of the bed; a flexible sheet on which a person may lie and extending over said mattress between said rollers; roller drive for winding said sheet from a roller at one bed and unwinding said sheet from a roller on the opposite bed end for pulling said sheet across the mattress surface so as to cause the person in a supine position to be transported across the bed onto the wheelchair with a person's back remaining on the bed; a pair of lift arms extending part way along the sides of the mattress and pivoted about a horizontal axis near and parallel to the foot-end of the mattress; lift drive means to rotate the pair of lift arms to a substantially vertical position; lifting support means connected to the lift arms for supporting the person so that he is lifted to a sitting position on the wheelchair by rotation of the lift arms; said wheelchair back means adapted to be placed behind the person.

2. An invalid transfer arrangement as defined in claim 1, wherein said wheelchair back means comprises a wheelchair back and a handcrank connected to a pinion engaging a rack attached to the wheelchair back for moving said back vertically and elevating said back between a position below said seat and a normal position above said seat.

3. An invalid transfer arrangement as defined in claim 1, wherein said wheelchair back means comprises a handcrank connected to a pinion engaging a rack attached to a back frame vertically movable; a horizontal roller comprising the top of the back frame being lowerable from a normal wheelchair height to below said seat, a sheet of material with one edge attached to said back frame behind said seat, the remainder of said sheet of material extending in front of said roller being wound on said roller by action of a spring on said roller as said roller is lowered and said sheet of material is unwound as said roller is raised.

4. An invalid transfer arrangement as defined in claim 1, wherein said wheelchair back means comprises a handcrank connected to a pinion engaging a rack attached to a back frame with a top side and a bottom side and being vertically movable; a first roller comprising said top side of the back frame and being lowerable from a predetermined wheelchair height to below said seat; a second roller mounted near said bottom side of said back frame; an endless belt of material extending between and around said first and second rollers, said wheelchair having a fixed frame, a front sheet of said endless belt being attached to the fixed frame of the wheelchair.

5. An invalid transfer arrangement as defined in claim 1, wherein said wheelchair back means comprises a member which can be manually attached and removed.

6. An invalid transfer arrangement as defined in claim 1, wherein said wheelchair back means comprises a back surface which can be opened and closed by a zipper.

7. An invalid transfer arrangement as defined in claim 1, wherein said wheelchair back means comprises a back having a back frame connected to the wheelchair frame by a hinge and a latch whereby the back can be moved aside, returned, and locked in place; said back having handles rotatably mounted to the back frame for extending backwards or sidewards.

8. An invalid transfer arrangement as defined in claim 1, wherein said wheelchair back means comprises a back having a back frame connected to the wheelchair frame by a slide and latch whereby the back can be moved aside, returned, and locked in place; said back having handles rotatably mounted to the back frame for extending backwards or sidewards.

9. An invalid transfer arrangement as defined in claim 1 wherein said roller drive means comprise at each end of the bed a reversible motor drive unit coupled through a first clutch to a drive roller; said motor drive unit being coupled through a second clutch and a third clutch to a sheet take-up roller with a shaft; said first and second clutches being overrunning so that in one direction of rotation said first and second clutches transmit full torque and in the other direction said overrunning clutches transmit substantially zero torque from input to output of said overruning clutches; said third clutch slipping when torque in either direction exceeds a predetermined value; a brake applied and adding friction to said take-up roller shaft; a pinch roller positioned along and adjacent to said drive roller; said flexible sheet passing between said pinch and drive rollers and around said take-up roller, said flexible sheet being attached to said take-up roller; control means for actuating each of said motors to drive in either direction.

* * * * *